United States Patent [19]

Shibata et al.

[11] Patent Number: 4,887,089

[45] Date of Patent: Dec. 12, 1989

[54] PLANAR ANTENNA FOR VEHICLES

[75] Inventors: Yoshihisa Shibata, Kariya; Hiroshi Mizuno, Nagoya, both of Japan

[73] Assignee: Nippondenso Co., Ltd., Kariya, Japan

[21] Appl. No.: 882,524

[22] Filed: Jul. 7, 1984

[30] Foreign Application Priority Data

Jul. 11, 1985 [JP] Japan ..... 60-152738

[51] Int. Cl.[4] ..... H01Q 00/00

[52] U.S. Cl. ..... 343/700 MS; 343/713

[58] Field of Search ..... 343/700 R, 700 MS, 701, 343/, 711, 713, 876

[56] References Cited

FOREIGN PATENT DOCUMENTS 56-141604 11/1981 Japan ..... 343/700 MS
58-29204 2/1983 Japan ..... 343/700 MS
0042330 3/1983 Japan ..... 343/700 MS
0059604 4/1983 Japan ..... 343/700 MS
0059605 4/1983 Japan ..... 343/700 MS

OTHER PUBLICATIONS

Japanese Abstract of Appln. 58-59605, Microstrip Antenna.

*Primary Examiner*—John D. Lee
*Assistant Examiner*—Robert E. Wise
*Attorney, Agent, or Firm*—Cushman, Darby & Cushman

[57] ABSTRACT

At least one microstrip antenna comprising a radiating conductor and a grounding conductor arranged on both sides of a dielectric substrate is mounted on a roof surface of an automobile. One or more feeders are each connected to a feeding position of the radiating conductor to excite the antenna in a higher-order mode.

6 Claims, 4 Drawing Sheets

PLANAR ANTENNA FOR VEHICLES

BACKGROUND OF THE INVENTION

1. Field of the Invention

The present invention relates to a planar antenna for moving objects which employs a microstrip antenna and which is well suited for installation on a moving object such as a vehicle.

2. Description of the Prior Art

With antennas heretofore used on vehicles such as automobiles (e.g., antennas for personal two-way radio, FM radio, etc.), the antenna directivity is preferably selected such that the antenna is omnidirectional in a horizontal plane and the beam is concentrated in a horizontal direction in a vertical plane and the long rod antenna is mounted on the vehicle body. Thus, there are problems during, for example, the running, garaging and washing of the vehicle.

On the other hand, as disclosed for example in JP-A-No. 56-715 for an "automobile antenna", a microstrip antenna has been proposed which is so constructed that it is small in size, light in weight and low-profile and this construction not only overcomes the foregoing deficiency but also is suited for mounting on a vehicle. When the antenna is excited in the ordinary feeding mode, however, it radiates radio waves in a direction vertical to the antenna surface.

As a result, where the above microstrip antenna is simply mounted on the surface of a vehicle such as an automobile, its directivity is confined in a particular direction. Thus, when using the antenna for signal transmission and reception in a radio system such as a personal two-way radio system or FM radio requiring a horizontal directivity, the antenna must be inclined from the horizontal plane by a given angle to effect the transmission and reception in the horizontal direction. And yet, in that case, the use of the single antenna gives only one directivity in a particular direction and thus there are disadvantages that a plurality of the microstrip antennas must be combined so as to obtain the desired omnidirectional directivity in the horizontal direction and in that the combined antenna height is also increased.

SUMMARY 0F THE INVENTION

With a view to overcoming the foregoing deficiencies in the prior art, it is an object of the present invention to provide a planar antenna which has a small-sized, light-weight and low-profile construction and also has an antenna characteristic which ensures a horizontal directivity suitable for the transmission and reception of radio waves on a vehicle.

To accomplish the above object, in accordance with this invention, there is thus provided a planar antenna comprising an antenna (microstrip antenna) including a radiating conductor and a grounding conductor arranged on both sides of a dielectric substrate, and mounted on the surface of a vehicle, a single or plurality of feeders connected to feeding positions on the radiating conductor which are suitable for desired mode excitation, and means for exciting the antenna in a higher-order mode through the feeders.

With this construction, when the antenna mounted on the surface of the vehicle is excited in the higher-order mode, the beam is no longer present in a vertical direction to the surface of the antenna and the beam is concentrated in horizontal directions thus making the construction suitable for the transmission and reception of radio waves in a horizontal direction.

DESCRIPTION OF THE PREFERRED EMBODIMENT

Figure 1:
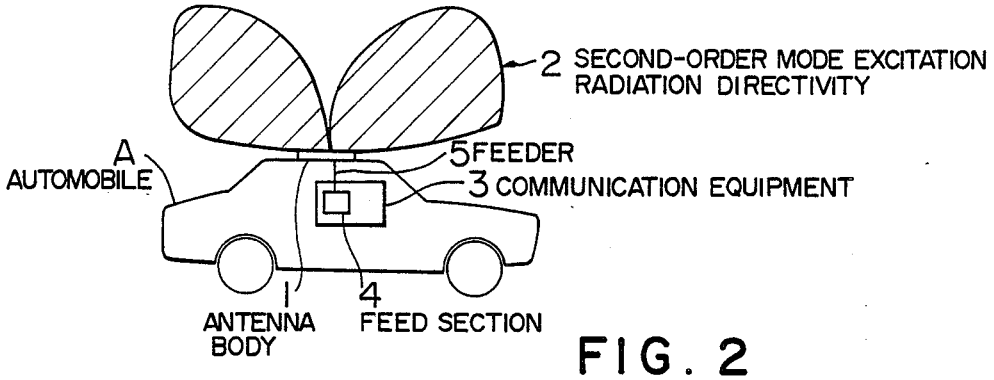
FIG. 1 is a schematic diagram showing the overall construction of an embodiment of the invention.
Figure 2:
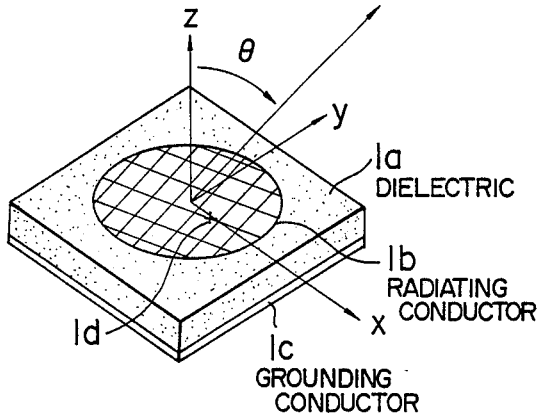
FIG. 2 is a perspective view showing the construction of the antenna.
Figure 3:
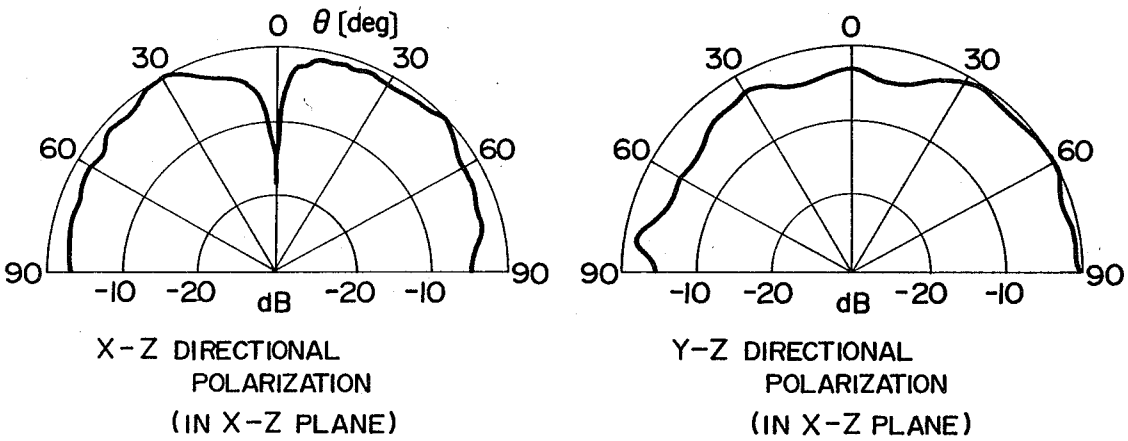
FIGS. 3 and 4 show antenna characteristics of the antenna.
Figure 4:
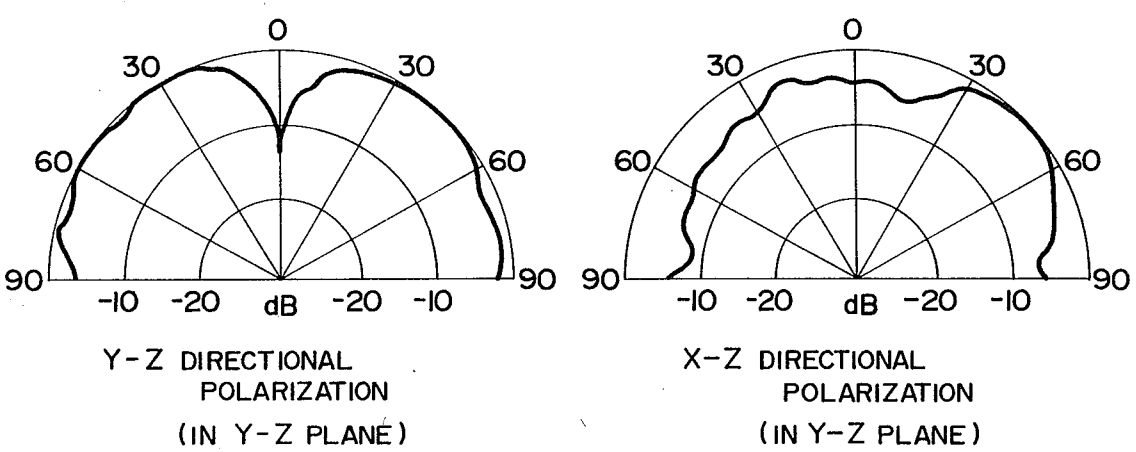

FIG. 1 shows the manner in which a planar antenna according to an embodiment of the invention is mounted on the roof of automobile and FIG. 2 shows the construction of the antenna. FIGS. 3 and 4 show antenna characteristics of the antenna.

In FIGS. 1 to 4, numeral 1 designates an antenna comprising a microstrip antenna mounted on the ceiling surface of an automobile A or a vehicle. Numeral 2 designates the radiation directivity of the antenna 1 when it is excited in the second-order higher mode. Numeral 3 designates communication equipment for effecting the transmission and reception of radio waves whereby the antenna 1 is excited in the second-order or higher-order mode through a feeder 5 from a feed section 4 within the communication equipment 3 thereby effecting the transmission and reception of radio waves in all the directions horizontally.

As shown in FIG. 2, the antenna 1 comprises a circular radiating conductor 1*b* disposed on one-side surface of a dielectric 1*a* in square plate form and a grounding conductor 1*c* disposed all over the opposite-side surface of the dielectric 1*a*. The shape of the radiating conductor 1*b* may be a torus shape, rectangular shape or the like. The feeder 5 is connected to the radiating conductor 1*b* at a feeding position 1*d* (a point designated by X) which is suitable for the excitation of the antenna 1 and the feeder 5 is connected to the feed section 4 of the communication equipment 3 through a hole formed through a portion of each of the grounding conductor 1*c* and the dielectric 1*a*. The dielectric 1*a* is made of a material of low dielectric loss, e.g., teflon or polyethylene. Thus, in the antenna 1 the electromagnetic field is confined between the radiating conductor 1*b* and the grounding conductor 1*c* and radio waves are radiated from their edges.

With the construction described above, the operation of the embodiment will now be described.

When the antenna 1 is excited in the second-order mode $TM_{21}$, the magnitude of the generated electric field varies as a function of a cosine $2\tau$ with respect angle $\tau(\tau=0°$ to $360°)$ measured from a reference axis connecting the feeding position 1*d* and the center point of the radiating conductor 1*b*, so that the electric field attains a maximum value (cosines 0° and cosines 360°) on the axes defined by 0° and 360° and the electric field attains a maximum value of the opposite sign (cosines 180° and 540°) on the axes defined by 180° and 540°. On the other hand, the electric field becomes zero with cosines 90°, 270°, 450° and 630° on the respective axes.

Thus, the directivities of the antenna excited in the second-order mode were measured and shown in FIGS. 3 and 4 according to the XYZ three-dimensional coordinate system of FIG. 2.

In other words, as will be seen from the diagram of X-Z directional polarization in the X-Z plane and the diagram of Y-Z directional polarization in the Y-Z plane of the coordinate system, practically there is no radiation of radio waves in a direction perpendicular to the antenna surface and strong radio waves are radiated in a horizontal direction ($\theta=\pm 90°$) thus making the characteristic of the antenna such that it has a directivity in the horizontal direction.

Another utility is that such a higher-order mode excitation of the invention enables with the single feeding position the transmission and reception of radio waves having Y-Z directional polarization in the X-Z plane and X-Z directional polarization in the Y-Z plane shown in the respective diagrams of FIGS. 3 and 4. Namely that the radio waves having the planes of polarization perpendicular to each other can be transmitted and received with the single feeding position. Thus, this is very useful differing from a fixed station in the automobile A or the vehicle is allowed to receive radio waves having planes of polarization perpendicular to each other.

A specific example of the dimensions and higher-order excitation (resonant) frequency of the antenna 1 will now be described.

Assuming now that h represents the thickness of the dielectric 1*a*, $\epsilon$ the dielectric constant of the dielectric 1*a* and a the radius of the radiating conductor 1*b*, a resonant frequency f is given by $$f_{nm} = \alpha_{nm} \cdot c/2\pi \cdot a_{eff} \cdot \sqrt{\epsilon}$$

where $\alpha_{nm}$ is a constant given as follows corresponding to each of the various modes, and c represents light velocity.

Also, the effective radius $a_{eff}$ is given by $$a_{eff} = a \cdot [1 + (2h/\pi \cdot a \cdot \epsilon) \cdot (l_n(\pi \cdot a/2h) + 1.7726)]^{1/2}$$

| | n | | | |
|---|---|---|---|---|
| m | $\alpha'_{0m}$ | $\alpha'_{1m}$ | $\alpha'_{2m}$ | $\alpha'_{3m}$ |
| 1 | 3.832 | 1.841 | 3.054 | 4.201 |
| 2 | 7.016 | 5.331 | 6.706 | 8.015 |
| 3 | 10.173 | 8.536 | 9.970 | 11.336 |
| 4 | | 11.706 | 13.170 | 14.59 |
| 5 | | 14.86 | 16.348 | 17.79 |

Then, when f=900 MHz (personal radio), $\epsilon=4.5$ and h=1.6 mm, the radius a in the second-order ($TM_{21}$) mode is given as $$a = 3.054 \times c/2\pi \cdot f \cdot \sqrt{\epsilon} = 76.38 \text{ mm}$$

On the other hand, when $\epsilon=4.5$, h=1.6 mm and a=46.04 mm, the resonant frequencies f in the respective higher-order modes ($TM_{21}$, $TM_{31}$) are given as $$f(TM_{21}) = 3.054 \times c/2\pi \times 46.04 \times \sqrt{\epsilon} = 1.49 \text{ GHz}$$

$$f(TM_{31}) = 4.201 \times c/2\pi \times 46.04 \times \sqrt{\epsilon} = 2.05 \text{ GHz.}$$

Figure 5A:
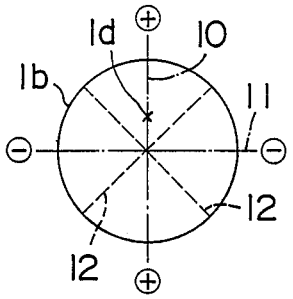
FIGS. 5(*a*), (*b*) and (*c*) show a second embodiment of the invention.
Figure 5B:
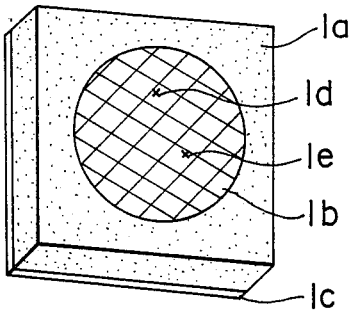
Figure 5C:
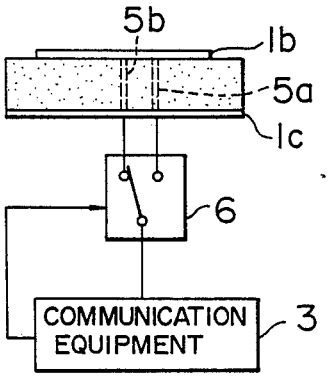

Referring now to FIG. 5, there are illustrated views useful for explaining a second embodiment of the invention in which the same numerals as in FIGS. 1 and 2 designate the same component parts. In FIG. 5 (*a*), with respect to the feeding position 1*d* of the radiating conductor 1*b*, there are an axis 10 on which the electric field attains a positive maximum value, an axis 11 which is perpendicular to the axis 10 and on which the electric field attains a negative maximum value and an axis 12 on which the electric field becomes zero, respectively.

Thus, as shown in FIG. 5(*b*), a second feeding position 1*e* is selected on the axis 12 and two feeders 5*a* and 5*b* are provided at the respective positions. A diversity function is provided by a change-over switch 6 which effects switching between the feeders 5*a* and 5*b*.

With the above-described construction, each of the feeders is provided on the axis on which the excitation electric field of the other feeder becomes zero and in this way the excitation is effected without any interference between the feeders.

Then, the antenna directivity obtainable with such a single feeding position becomes as shown in FIGS. 3 and 4 and it is not omnidirectional with horizontal plane. Thus, considering various radio environments, two feeding positions are advantageously provided so that change-over from one to the other having a better characteristic is effected and the direction of the antenna is changed electrically thus obtaining a diversity function which ensures the optimum receiving condition and thereby improving the antenna characteristic.

In this case, the change-over between the feeding positions can be effected by selecting and determining one of the feeding positions having a better condition by checking the intensities, distortions or the like of the input signals to the communication equipment and thereby improving the antenna characteristic.

Figure 6:
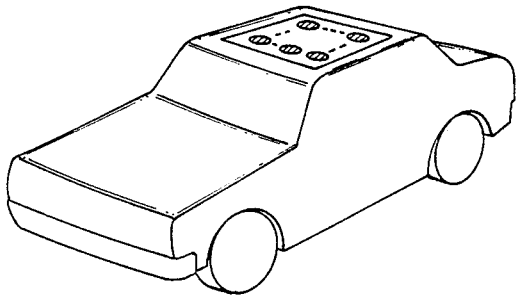
FIG. 6 is a schematic diagram showing the construction of a third embodiment.

Referring to FIG. 6, there is illustrated a perspective view showing a third embodiment of the invention and this embodiment comprises an array antenna including a plurality of unit antennas. The power is supplied to each of the unit antennas by controlling their amplitudes and phases so as to attain the required characteristics of the array.

While, in the above-described embodiments, the excitation is made in the higher-order or second-order mode, the excitation may be made in any other higher-order mode such as a third-order or fourth-order mode.

From the foregoing description it will be seen that in accordance with the invention, by virtue of the fact that an antenna comprising a microstrip antenna and mounted on the surface of a vehicle is excited in a higher-order mode, there is a great effect of providing an antenna having a small-sized, light-weight and low-profile construction and having a characteristic of radiating no substantial beam in a vertical direction and having a high directivity in horizontal directions, these features being well suited for use with vehicles.

We claim:

1. A planar antenna for a vehicle comprising:

a dielectric substrate;

an antenna including a radiating conductor and a grounding conductor arranged on both sides of said dielectric substrate to oppose each other, said antenna being mounted on a surface of a vehicle;

at least one feeder connected to a feeding position of said radiating conductor suitable for excitation; and means for exciting through said feeder said antenna substantially at a resonance frequency of a higher-order resonance mode higher than that of a primary resonance mode;

said antenna being a microstrip antenna having said dielectric substrate formed in a rectangular plate, said radiating conductor formed in a circular plate mounted in a partial area on the side surface of said dielectric substrate and said grounding conductor mounted entirely on the opposite side surface of said dielectric substrate;

said microstrip antenna being excited in a higher-order excitation mode at a resonant frequency $f_{nm}$ given as follows with a constant $\alpha_{nm}$ inherent to the mode, thickness h and dielectric constant $\epsilon$ of said dielectric substrate and radius a of said circular plate:

$$f_{nm} = \alpha_{nm} \cdot c/2\pi \cdot a_{eff} \cdot \sqrt{\epsilon}\ , \text{ and}$$

$$a_{eff} = a \cdot \left[1 + \left(\frac{2h}{\pi \cdot a \cdot \epsilon}\right) \cdot \left(\ln\left(\frac{\pi \cdot a}{2h}\right) + 1.7726\right)\right]^{\frac{1}{2}}.$$

2. A planar antenna according to claim 1, wherein said antenna is a microstrip antenna to be excited in a second-order mode $TM_{21}$.

3. A planar antenna according to claim 1, wherein said antenna is a microstrip antenna having said dielectric substrate formed in a rectangular plate, said radiating conductor formed in a circular plate mounted in partial area on the side surface of said dielectric substrate and said grounding conductor mounted entirely on the opposite side surface of said dielectric substrate.

4. A planar antenna according to claim 1, wherein said dielectric substrate is made of a material of low dielectric loss such as teflon or polyethylene.

5. A planar antenna system as in claim 1, further comprising:

a plurality of feeders, each connected to one of a plurality of independent feeding positions, angularly spaced apart from each other, of said radiating conductor; and switch means for selecting any desired one of said feeders, for exciting through the selected feeder said antenna substantially at a harmonic frequency of a fundamental resonance frequency of said antenna, wherein each of said feeding positions of said radiating conductor is determined to receive substantially no excitation electric field applied from the other being excited, whereby said system provides a single-frequency diversity function.

6. A planar antenna system as in claim 1, further comprising:

means for operating through said feeder said antenna substantially at a harmonic frequency of a fundamental resonance frequency of said antenna whereby said antenna can exhibit an enhanced horizontal directivity with a significantly-suppressed vertical directivity to the surfaces of said substrate.

* * * * *